US008126344B2

(12) United States Patent
Handa et al.

(10) Patent No.: US 8,126,344 B2
(45) Date of Patent: Feb. 28, 2012

(54) IMAGE FORMING APPARATUS WITH VARIABLE AMPLITUDE ALTERNATING CURRENT TO MITIGATE IMAGE DEFECTS AND PHOTOCONDUCTOR WEAR

(75) Inventors: Osamu Handa, Kanagawa (JP); Yoshihisa Kitano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 537 days.

(21) Appl. No.: 12/259,621

(22) Filed: Oct. 28, 2008

(65) Prior Publication Data

US 2009/0269092 A1 Oct. 29, 2009

(30) Foreign Application Priority Data

Apr. 23, 2008 (JP) ..... P2008-111975

(51) Int. Cl.
*G03G 15/02* (2006.01)

(52) U.S. Cl. ..... 399/50; 399/168

(58) Field of Classification Search ..... 399/50, 399/168, 174

See application file for complete search history.

(56) References Cited

U.S. PATENT DOCUMENTS 5,089,851 A * 2/1992 Tanaka et al. ..... 399/176
6,539,184 B2 * 3/2003 Shimura et al. ..... 399/50
2006/0115286 A1 * 6/2006 Uchitani et al. ..... 399/50
2006/0245775 A1 * 11/2006 Takahashi et al. ..... 399/50
2008/0152371 A1 * 6/2008 Burry et al. ..... 399/50
2008/0170869 A1 * 7/2008 Ramesh et al. ..... 399/49
2009/0274474 A1 * 11/2009 Aoshima et al. ..... 399/44

FOREIGN PATENT DOCUMENTS

JP 07-175296 7/1995
JP 2001-281968 A 10/2001
JP 2004-333789 11/2004
JP 2006-276054 10/2006

* cited by examiner

*Primary Examiner* — David Gray
*Assistant Examiner* — G. M. Hyder
(74) *Attorney, Agent, or Firm* — Morgan, Lewis & Bockius LLP

(57) ABSTRACT

An image forming apparatus including an image carrier that includes a photoconductive layer on which an electrostatic latent image is formed, a charging member that comes in contact with the image carrier and charges the photoconductive layer, and a feeding section that supplies a current to the charging member by applying a vibration voltage with an alternating current component superposed on a direct current component, wherein the alternating current component may contain a first amplitude that eliminates charging non-uniformity when the vibration voltage is applied with a uniform amplitude and a second amplitude that is smaller than the first amplitude.

8 Claims, 6 Drawing Sheets

| Vpp | WHITE POINT (Φ0. 15 mm OR MORE) | | MARGIN |
|---|---|---|---|
| 1. 5 kV | VERY BAD | OCCURRENCE ON FULL FACE | 7% |
| 1. 6 kV | BAD | OCCURRENCE OF ABOUT 5 TO 30 POINTS EACH 1 cm SQUARE | 14% |
| 1. 7 kV | MEDIOCRE | OCCURRENCE OF ABOUT ONE POINT EACH 1 cm SQUARE | 21% |
| 1. 8 kV | GOOD | OCCURRENCE OF NO POINTS | 29% |

FIG. 7A

CHANGE FOR EACH WAVELENGTH

| Vpp-L | Vpp-S | OCCURRENCE OF WHITE POINT |
|---|---|---|
| 1.8 | 1.7 | OCCURRENCE OF ABOUT 0.1 POINT 1 cm SQUARE |
| | 1.6 | OCCURRENCE OF ABOUT 0.2 POINT 1 cm SQUARE |
| | 1.5 | OCCURRENCE OF ABOUT 0.4 POINT 1 cm SQUARE |

FIG. 7B

CHANGE EVERY TWO WAVELENGTH

| Vpp-L | Vpp-S | OCCURRENCE OF WHITE POINT |
|---|---|---|
| 1.8 | 1.7 | NO OCCURRENCE |
| | 1.6 | OCCURRENCE OF ABOUT 0.5 POINT 1 cm SQUARE |
| | 1.5 | OCCURRENCE OF ABOUT ONE POINT 1 cm SQUARE |

FIG. 7C

EVERY FOURTH IS Vpp-S

| Vpp-L | Vpp-S | OCCURRENCE OF WHITE POINT |
|---|---|---|
| 1.8 | 1.7 | NO OCCURRENCE |
| | 1.6 | NO OCCURRENCE |
| | 1.5 | OCCURRENCE OF ABOUT 0.02 POINT 1 cm SQUARE |

FIG. 7D

SWITCH AT HALF WAVELENGTH

| Vpp-L | Vpp-S | OCCURRENCE OF WHITE POINT |
|---|---|---|
| 1.8 | 1.7 | NO OCCURRENCE |
| | 1.6 | OCCURRENCE OF ABOUT ONE POINT 1 cm SQUARE |
| | 1.5 | OCCURRENCE OF ABOUT THREE POINT 1 cm SQUARE |

FIG. 7E

DC SHIFT IS APPLIED TO THE CASE OF FIGs. 7C AND 8C
(CORRECTION OF RIPPLE)

| | AT Vpp-L | AT Vpp-S | |
|---|---|---|---|
| Vpp | 1.8 kV | 1.6 kV | LATERAL STRIPE |
| Vdc | -750 V | -750 V | OCCURRENCE |
| | -750 V | -760 V | SLIGHT |
| | -750 V | -770 V | NO OCCURRENCE |

FIG. 9

| | | PHOTOCONDUCTIVE LAYER WEAR RATE | WEAR AMOUNT (μm) AT 300 kcycle |
|---|---|---|---|
| COMPARATIVE EXAMPLE | Vpp = 1.8 kV | 35 nm/kcycle | 10.5 |
| 7C-1 | Vpp max = 1.8<br>Vpp min = 1.7 | 32 nm/kcycle | 9.6 |
| 7C-2 | Vpp max = 1.8<br>Vpp min = 1.6 | 29 nm/kcycle | 8.7 |

IMAGE FORMING APPARATUS WITH VARIABLE AMPLITUDE ALTERNATING CURRENT TO MITIGATE IMAGE DEFECTS AND PHOTOCONDUCTOR WEAR

CROSS-REFERENCE TO RELATED APPLICATIONS

This application is based on and claims priority under 35 U.S.C. 119 from Japanese Patent Application No. 2008-111975 filed Apr. 23, 2008.

BACKGROUND

1. Technical Field

This invention relates to an image forming apparatus.

2. Related Art

An electrophotographic image forming apparatus includes an image carrier having a photoconductive layer on which an electrostatic latent image is formed. First, the photoconductive layer is charged and the charge is eliminated in association with image information formed by irradiating the photoconductive layer with a laser, etc., and an electrostatic latent image is formed on the photoconductive layer. This electrostatic latent image is developed using a developing material of toner, etc., and is transferred to a record medium such as a sheet of paper to form an image.

As a system of charging the photoconductive layer, a system of supplying a current from a feeding section through a charging member that comes in contact with the image carrier and charges the photoconductive layer is known. The feeding section supplies a current to the charging member by applying a voltage thereto. The applied voltage is a vibrating voltage with an AC (alternating current) component superposed on a DC (direct current) component (which will be hereinafter referred to as vibration voltage). If only a DC component exists, when the potential difference between the photoconductive layer and the charging member lessens, a further current does not flow and the photoconductive layer cannot be charged to a necessary value. An AC component is superposed, whereby the photoconductive layer is charged to a potential almost equal to the DC component.

When the amplitude of the AC component is small, the charge potential of the photoconductive layer increases in response to an increase in the amplitude. When the charge potential becomes equal to the DC component, if the amplitude of the AC component is further increased, saturation occurs and the charge potential does not change. The boundary between a region where the charge potential increases with an increase in the amplitude of the AC component and a region where the charge potential does not change is referred to as a saturation point. If the amplitude of the AC component is set to the amplitude or more at the saturation point, the photoconductive layer is charged to the necessary potential, as mentioned above. However, although the amplitude is set to the amplitude or more at the saturation point, if it is close to the amplitude at the saturation point, the photoconductive layer is not uniformly charged (charging non-uniformity is occurred) and a minute image defect called a white spot occurs. To suppress occurrence of the image defect, a vibration voltage containing an AC component having amplitude which is sufficiently larger than the amplitude at the saturation point is applied.

SUMMARY

According to an aspect of the invention, there is provided an image forming apparatus, comprising an image carrier that includes a photoconductive layer on which an electrostatic latent image is formed; a charging member that comes in contact with the image carrier and charges the photoconductive layer; and a feeding section that supplies a current to the charging member by applying a vibration voltage with an alternating current component superposed on a direct current component, wherein the alternating current component may contain a first amplitude that eliminates charging non-uniformity when the vibration voltage is applied with a uniform amplitude and a second amplitude that is smaller than the first amplitude.

BRIEF DESCRIPTION OF THE DRAWINGS

Exemplary embodiment of the present invention will be described in detail based on the following figures, wherein:

FIGS. 7A to 7E show the experimental results concerning occurrence of white points when voltage with two types of amplitudes (large and small) mixed is applied;

FIG. 9 shows the experimental results concerning the wear amounts of the photoconductive layer.

DETAILED DESCRIPTION

Figure 1:
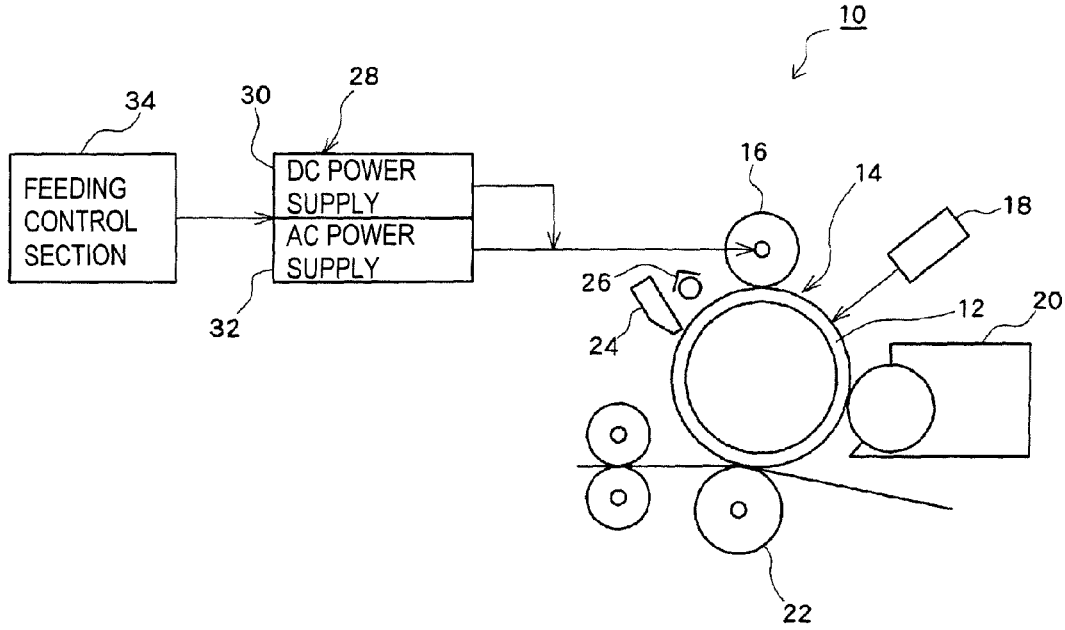
FIG. 1 shows the main configuration of an image forming apparatus of an embodiment of the invention.

Referring now to the accompanying drawings, there is shown an exemplary embodiment of the invention. FIG. 1 is a schematic configuration drawing of an image forming apparatus 10. This image forming apparatus 10 is an electrophotographic apparatus and has an image carrier 14 with a layer of a photoconductor (which will be hereinafter referred to as photoconductive layer) 12 formed on a surface. In the image forming apparatus 10, the image carrier 14 is formed as a roll having a columnar surface, but an image carrier shaped like an endless belt is also known and may be used. The image carrier 14 is surrounded by a charging member 16 that charges the photoconductive layer 12, an exposure device 18 that exposes the photoconductive layer 12 to form an electrostatic latent image, and a developing device 20 that develops the electrostatic latent image. The charging member 16 shapes like a cylinder or a column.

In FIG. 1, a predetermined position on the photoconductive layer 12 passes through the positions opposed to the charging member 16, the exposure device 18, and the developing device 20 in order with clockwise rotation of the image carrier 14. The charging member 16 is brought into contact with or close to the photoconductive layer 12 and charges the photoconductive layer 12 over the whole in the width direction of the photoconductive layer 12, namely, in the direction crossing the move direction of the photoconductive layer 12. The surface of the charged photoconductive layer 12 is radiated with a laser of the exposure device 18 and the charge in the exposed portion disappears. The laser is modulated in response to the image to be formed and the surface potential of the photoconductive layer 12 changes in response to the modulation and accordingly an electrostatic latent image is formed on the photoconductive layer 12. The developing device 20 supplies a developer like toner, etc., to the surface of the photoconductive layer 12 and accordingly the electrostatic latent image is developed and a developer image is formed on the surface of the image carrier 14.

The image carrier 14 is further surrounded by a transfer roll 22 that forms a narrow gap or a nip between the transfer roll 22 and the image carrier 14. The developed developer image is moved to the position (nip) opposed to the transfer roll 22 with rotation of the image carrier 14 in a state in which the image is supported on the image carrier 14. At the nip, the developer image is transferred to a record medium sheet like a paper, etc., conveyed in synchronization with the move of the developer image.

The image carrier 14 is further surrounded by a cleaning member 24 and a static eliminator 26 so that the photoconductive layer 12 after the developer is transferred is made ready for the next step. The cleaning member 24 like a cleaning blade, etc., scrapes off the untransferred and remaining developer and then the static eliminator 26 like a static eliminating lamp, etc., removes the charge on the photoconductive layer 12, namely, the surface of the image carrier 14.

A voltage is applied and a current is supplied to the charging member 16 from a feeding section 28. The feeding section 28 contains a DC power supply 30 and an AC power supply 32 and applies a vibration voltage with an AC component superposed on a DC component. Hereinafter, the DC component of the applied voltage will be referred to as DC voltage Vdc, the AC component as AC voltage Vac, and the amplitude thereof as alternating amplitude Vpp (hereinafter referred to as amplitude Vpp). The AC component typically is a sine wave, but may be a waveform such as a square wave or a triangular wave. The surface potential of the photoconductive layer will be referred to as surface potential Vpr.

The charger of the exemplary embodiment will be discussed. The charging member 16 is disposed in contact with the photoconductor surface and charges the photoconductor surface by applying a DC voltage or an AC voltage applied to DC voltage. The charging member 16 is shaped like a roll having a resistance elastic layer provided in the surrounding of a core and the resistance elastic layer may also be divided into a resistance layer and an elastic layer that supports the resistance layer in order from the outside. Further, to give durability and stain resistance to the charger, a protective layer may be provided on the outside of the resistance layer as required.

The charging member having a core provided with an elastic layer, a resistance layer, and a protective layer will be discussed below in more detail: As a material of the core, an electrically conductive material, generally, iron, copper, brass, stainless steel, aluminum, nickel, etc., is used. Any material other than metal may be used if it is a material having electric conductivity and adequate rigidity; for example, a resin molded component with electrically conductive particles, etc., dispersed, ceramics, etc., may also be used. The charging member may be shaped not only like a roll, but also like a hollow pipe.

As a material of the elastic resistance layer, an electrically conductive or semiconductive material, generally, a resin material or a rubber material with electrically conductive particles or semiconductive particles dispersed is used. As the resin material, a synthetic resin such as a polyester resin, an acrylic resin, a melamine resin, an epoxy resin, a urethane resin, a silicon resin, a urea resin, or a polyamide resin or the like is used. As the rubber material, ethylene-propylene rubber, polybutadiene, natural rubber, polyisobutylene, chloroprene rubber, silicon rubber, urethane rubber, epichlorohydrin rubber, phlorosilicone rubber, ethylene oxide rubber, etc., or a foamed material providing by foaming them is used.

As the conductive particles or the semiconductive particles, carbon black, metal of zinc, aluminum, copper, iron, nickel, chromium, titanium, etc., a metal oxide of ZnO—$Al_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $Sb_2O_3$, $In_2O_3$, ZnO, MgO, etc., an ionic compound of quaternary ammonium salt, etc., or the like may be used and any of these materials may be used solely or a mixture of the two or more materials may be used. Further, one or two or more of inorganic fillers of talc, alumina, silica, etc., and organic fillers of fine powder of fluorine resin, silicon rubber, etc., may be mixed as required.

As a material of the surface layer, a material with electrically conductive particles or semiconductive particles dispersed in a binding resin and having resistance controlled is used; the resistivity is from $10^3$ to $10^{14}$ Ω·cm, preferably from $10^5$ to $10^{12}$ Ω·cm, more preferably from $10^7$ to $10^{10}$ Ω·cm. The film thickness is from 0.01 to 1000 μm, preferably from 0.1 to 500 μm, more preferably from 0.5 to 100 μm. As the binding resin, an acrylic resin, a cellulose resin, a polyamide resin, methoxymethylated nylon, ethoxymethylated nylon, a polyurethane resin, a polycarbonate resin, a polyester resin, a polyethylene resin, a polyvinyl resin, a polyallylate resin, a polythiophene resin, a polyolefin resin of PFA, FEP, PET, etc., a styrene-butadiene resin, a melamine resin, an epoxy resin, a urethane resin, a silicon resin, a urea resin, etc., is used.

As the conductive particles or the semiconductive particles, one or two or more of carbon black, metal, and a metal oxide like the elastic layer and ionic compounds of quaternary ammonium salt, etc., revealing ionic conductivity are mixed. Further, one or two or more of antioxidants like hindered phenol, hindered amine, etc., inorganic fillers of clay, kaolin, talc, silica, alumina, etc., organic fillers of fine powder of fluorine resin, silicon resin, etc., lubricants of silicone oil, etc., may be added as required. Further, a surface active agent, a charge control agent, etc., is added as required.

As a method to form the layers, a blade coating method, a mayer bar coating method, a spray coating method, an immersion coating method, a bead coating method, an air knife coating method, a curtain coating method, etc., may be used.

Figure 2:
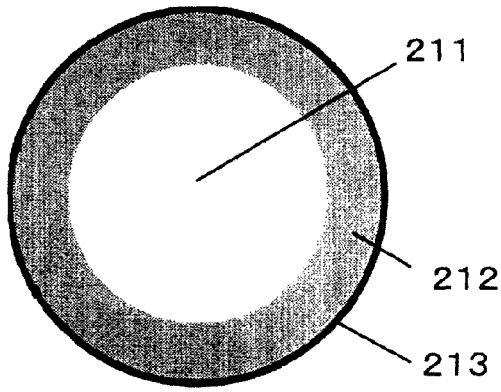
FIG. 2 shows the cross section of a charging member.

The charging member used in an example will be discussed below: As the charger used in the example, a roll having an outer diameter of 12 mm with an elastic resistance layer 212 and a surface layer 213 deposited in order on a metal core 211 as shown in FIG. 2 is used.

As a metal core bar, a SUM roll having a diameter of 8 mm subjected to electroless nickel plating treatment is used. The elastic resistance layer formed on the periphery of the core bar is formed with a master batch with CB (carbon black) dispersed on epichlorohydrin rubber manufactured by Nihon Zeon and an additive of a curing agent, a vulcanization accelerator, an antioxidant, etc., is appropriately added for molding and the surface is finished at ten-point mean roughness of from 1 to 5 μm with a thickness of 2 mm by plunge grinding. Further, as the surface layer, a nylon resin manufactured by Nagase Chemtech is dissolved with a MEK solvent as a base resin and CB and a sparse surface filler are dispersed and further an additive of a crosslinking agent, a dispersing agent, etc., is appropriately added to form a coat layer having a thickness of from 5 to 50 μm by an immersion method.

Figure 3:
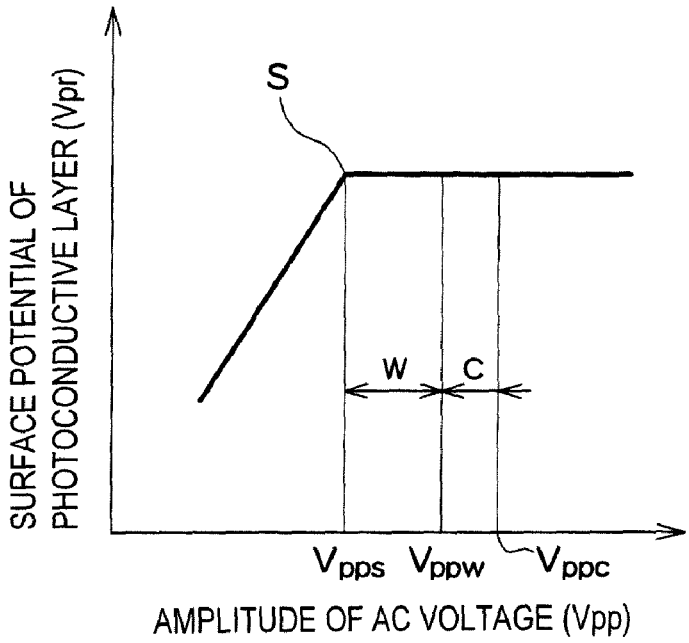
FIG. 3 shows the relationship between the surface potential of a photoconductive layer and the amplitude of an AC voltage.

FIG. 3 shows the schematic relationship between the surface potential Vpr of the charged photoconductive layer 12 and the amplitude of the vibration voltage, namely, the amplitude Vpp of the AC voltage. The amplitude of the AC voltage is gradually increased. In a region where the amplitude Vpp of the AC voltage is small, the photoconductive layer surface potential Vpr rises with an increase in the amplitude Vpp of the AC voltage. When the surface potential becomes one value or more, if the amplitude is increased, namely, if the AC voltage Vac is increased, the surface potential becomes a constant value and become saturated. The point at which the saturation is reached is referred to as saturation point S, and the amplitude of the AC voltage at this time is referred to as saturation point amplitude Vpps. The saturation point S changes upon reception of the effects of the environmental conditions of temperature, humidity, etc., the film thickness of the photoconductive layer 12, the resistance value of the charging member, and the like. To find the saturation point S accurately, the amplitude of the applied Vpp AC voltage and the surface potential Vpr of the charged photoconductive layer 12 may be measured at regular time intervals and the saturation point S at the point in time may be calculated from the amplitude Vpp and the surface potential Vpr.

Although the amplitude Vpp is the saturation point amplitude Vpps or more, if the amplitude Vpp is comparatively close to the saturation point amplitude Vpps, charging non-uniformity occurs on the photoconductive layer 12 and, for example, the charging non-uniformity causes an image defect like a white spot (which will be hereinafter referred to simply as white spot) whose diameter is about 0.15 mm to about 0.5 mm to occur on an image. To suppress the occurrence of the charging non-uniformity and to eliminate the white spot, it is necessary to further apply AC voltage of large amplitude Vpp. If the amplitude is increased gradually from the saturation point amplitude Vpps, the white spot decreases and disappears in time. The amplitude Vpp at this time is referred to as white spot disappearance amplitude Vppw. The range from the saturation point amplitude Vpps at which a white spot occurs to the white spot disappearance amplitude Vppw is referred to as white spot margin W. This white spot margin W may be corrected based on parameters of the environmental conditions of temperature, humidity, etc., the film thickness of the photoconductive layer 12, the resistance value of the charging member, and the like.

The amplitude Vpp of the actually applied voltage is a control amplitude Vppc provided by further giving a margin to the white spot disappearance amplitude Vppw. The range from the white spot disappearance amplitude Vppw to the control amplitude Vppc is referred to as control margin C. The control margin C is a margin to prevent a white spot from occurring if the measurement accuracy of the saturation point S is low.

Figure 4:
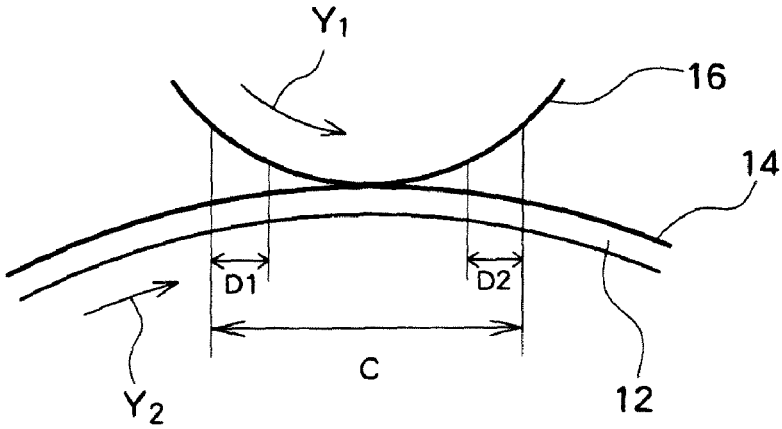
FIG. 4 shows an outline of the vicinity of contact between an image carrier and the charging member.

FIG. 4 is an enlarged view of the vicinity of the position where the image carrier 14 and the charging member 16 come in contact with each other. The charging member 16 and the image carrier 14 rotate in the directions of arrows Y1 and Y2 in the figure. A move of charge from the charging member 16 to the image carrier 14 is made at the contact position therebetween and the surrounding. The range in which the charge move occurs is indicated by a charge region C. A region where the charging member 16 and the image carrier 14 are close to each other exists at upstream and downstream of the rotation direction of the charging member 16 and the image carrier 14 with respect to the contact position. If the spacing between the image carrier 14 and the charging member 16 is one value or less, discharge occurs. This range is indicated by discharge region D1, D2. While the image carrier, namely, a predetermined position of the photoconductive layer 12 passes through the charge region C, the voltage supplied from the AC power supply is increased and decreased repeatedly and the image carrier 14 is charged to a predetermined potential. At this time, the charge potential of the photoconductive layer fluctuates in response to the increase and decrease in the voltage. The rotation speed of the image carrier 14 and the frequency of the voltage applied by the feeding section 28 are determined so as to set a spatial frequency at which the potential fluctuation is inconspicuous, for example, 6 cycles/mm. The spatial frequency is found by dividing the voltage frequency by the rotation speed of the image carrier 14. At this time, while a predetermined position of the image carrier 14 passes through the from 0.3 or about 0.3 to 0.6 or about 0.6 mm discharge region D2 where discharge occurs on the downstream side of the charge area in FIG. 4, the predetermined position of the image carrier 14 is subjected to the voltage increase and decrease about twice to four times.

In the AC power supply 32, the amplitude of the AC voltage to be applied may be changed and particularly, while a predetermined position of the photoconductive layer 12 passes through the discharge region D, a voltage of a different amplitude may be applied.

For example, to apply an AC voltage increased and decreased four times (four-cycle AC voltage) while a predetermined position passes through the discharge region D2, the amplitude of one cycle is controlled small. First amplitude Vpp-L of large amplitude is control amplitude Vppc, namely, amplitude provided by giving the white spot disappearance margin W and the control margin C to the saturation point amplitude Vpps. Second amplitude Vpp-S of lessened amplitude is amplitude less than the control amplitude Vppc. The second amplitude Vpp-S may be set less than the white spot disappearance amplitude Vppw.

Figures 5, 6:
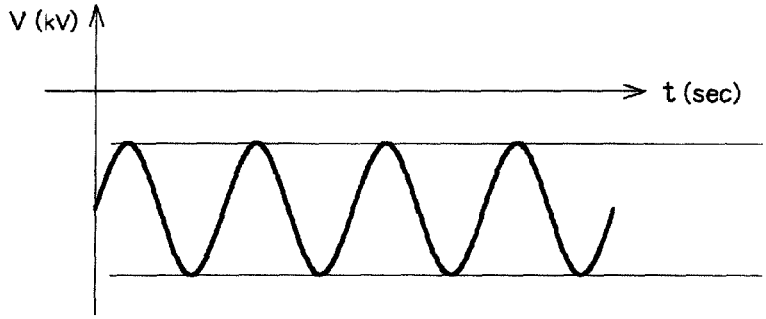
FIG. 5 shows the experimental result concerning occurrence of a white point having a diameter of 0.15 mm or more when a voltage is applied with a uniform amplitude.
FIG. 6 shows vibration voltage of uniform amplitude.

FIG. 5 shows data concerning occurrence of a white point when a voltage is applied with a uniform amplitude Vpp shown in FIG. 6. An experiment is conducted by changing the AC voltage amplitude Vpp to 1.5, 1.6, 1.7, and 1.8 kV under the conditions of DC voltage −750 V, AC voltage frequency 1300 Hz, and process speed 160 mm/s. The saturation point amplitude Vpps is 1.4 kV and the margins of the above-mentioned amplitudes relative to the saturation point amplitude 1.4 kV are 7% when the amplitude is 1.5 kV, 14% when the amplitude is 1.6 kV, 21% when the amplitude is 1.7 kV, and 29% when the amplitude is 1.8 kV. Here, "margin" refers to a ratio of the white spot margin W to the saturation point amplitude Vpps, namely, $W/Vpps \cdot 100 = (Vppw - Vpps)/Vpps \cdot 100(\%)$. When the amplitude Vpp is 1.8 kV, no white point occurs, as shown in FIG. 5. If the amplitude Vpp is 1.7 kV, occurrence of about one white point being 1 cm square is recognized. When the amplitude Vpp is 1.6 kV, the number of white points increases to five to 30 and when the amplitude Vpp is 1.5 kV, white points occur on the full face. Therefore, it is considered that the white spot disappearance amplitude Vppw exceeds 1.7 kV and is 1.8 kV or less.

Figure 8A:
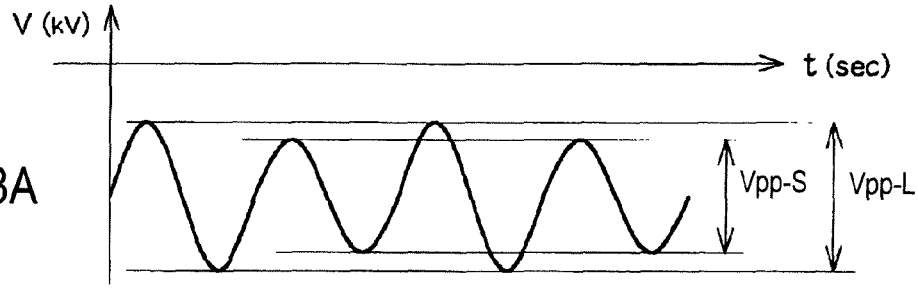
FIGS. 8A to 8E show vibration voltages used with the experiment in FIG. 6.

FIGS. 7A to 7E show the observation results of occurrence of white points by setting the first amplitude Vpp-L to 1.8 kV and changing the second amplitude Vpp-S to 1.7 kV, 1.6 kV, and 1.5 kV. FIGS. 8A to BE show applied voltages. The value of DC voltage (except FIG. 7E), the frequency of AC voltage, and the like are similar to those in FIG. 5. Waveforms each containing two types of waves different in amplitude will be discussed below. For simplicity, the time period between appearance of one peak of waveform and appearance of another peak is referred to as cycle. While a predetermined position on the photoconductive layer 12 passes through the discharge region D, the number of peaks of vibration voltage is four.

Figure 8B:
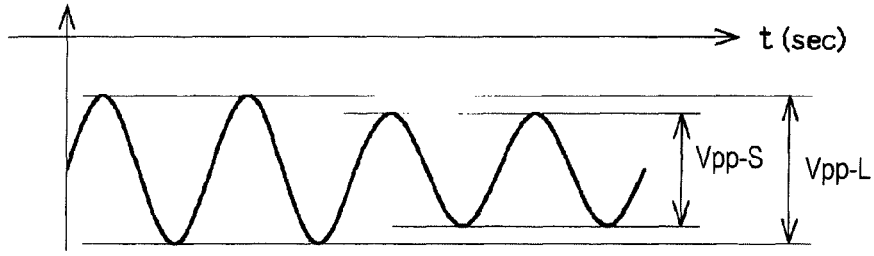
Figure 8C:
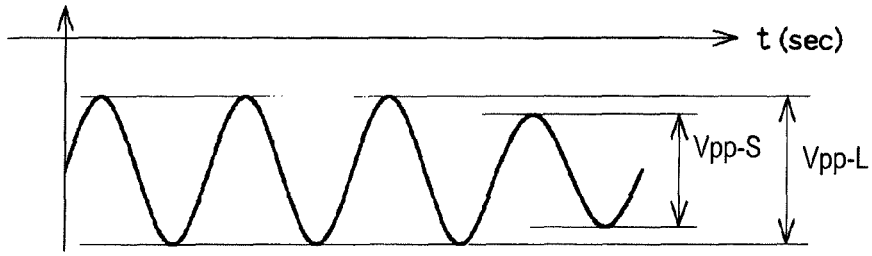
Figure 8D:
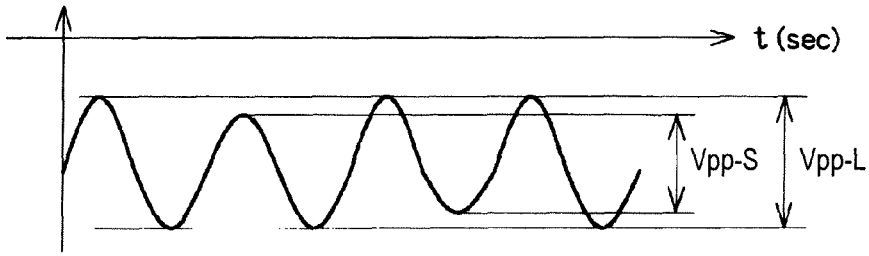
Figure 8E:
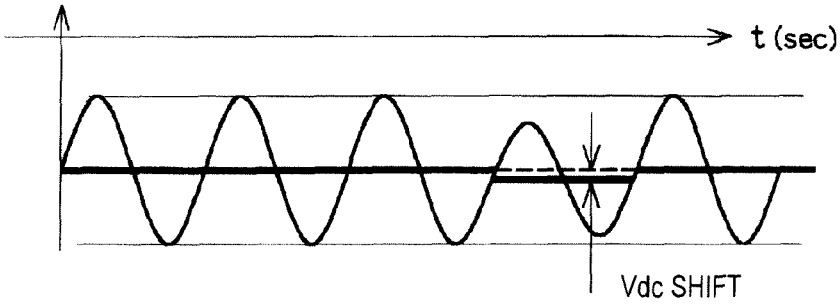

FIGS. 7A and 8A show the case where the first amplitude Vpp-L and the second amplitude Vpp-S are switched for each cycle. This means that the amplitude is repeated large small large small . . . . In this case, although occurrence of white points is suppressed as a whole, slight occurrence of a white point is observed when the second amplitude Vpp-S is even 1.7 kV. FIGS. 7B and 8B show the case where the first amplitude Vpp-L and the second amplitude Vpp-S are switched every two cycles. This means that the amplitude is repeated large large small small large large small small . . . . Although no white point occurs when the second amplitude Vpp-S is 1.7 kV, occurrence of a white point is observed when the second amplitude Vpp-S is 1.6 kV or less. FIGS. 7C and 8C show the case where the first amplitude Vpp-L is repeated three cycles and then the second amplitude Vpp-S is one (large large large small large large large small . . . ). A white point does not occurred until 1.6 kV and occurrence of a white point is slight even the second amplitude Vpp-S is 1.5 kV. FIGS. 7D and 8D show the case where the second amplitude Vpp-S cuts twice into in a half wavelength. The first one cycle is the first amplitude Vpp-L and the next half cycle is the second amplitude Vpp-S, followed by the first amplitude Vpp-L of one cycle, the second amplitude Vpp-S of a half cycle, the first amplitude Vpp-L of one cycle. When the second amplitude Vpp-S is 1.7 kV, no white point occurs; otherwise, occurrence of white points is recognized. FIGS. 7E and 8E show the case where the first amplitude Vpp-L and the second amplitude Vpp-S are fixed to 1.8 kV and 1.6 kV respectively and when the second amplitude Vpp-S is applied, the DC voltage Vdc is changed. The first amplitude Vpp-L is repeated three cycles and then the second amplitude Vpp-S of one cycle is applied as in FIGS. 7C and 8C described above. When a shift is made to −770 V, a white point disappears.

FIG. 9 shows the wear amounts of the photoconductive layer 12. The case where the amplitude Vpp is set to 1.8 kV with no occurrence of a white point in FIG. 5 is shown as a comparison example. As examples at which the amplitude is varied, the case where the second amplitude Vpp-S is changed to 1.7 kV and 1.6 kV in FIG. 7C are shown (Examples 7C-1 and 7C-2). It is seen that the smaller the second amplitude Vpp-S, the smaller the wear of the photoconductive layer.

In the experiment described above, the time during which a predetermined position on the photoconductive layer 12 passes through the discharge region D2 corresponds to four cycles of the vibration voltage and how many times the second amplitude Vpp-S is to be entered into the four cycles has been examined. However, the second amplitude Vpp-S may be entered at a less frequency. For example, the second amplitude Vpp-S may be entered once in eight cycles. The number of the cycles of the vibration voltage corresponding to the time during which an arbitrary position on the photoconductive layer 12 passes through the discharge region is not limited to four.

In the experimental example described above, the second amplitude Vpp-S is less than the white spot disappearance amplitude Vppw, but may be an amplitude equal to or larger than the white spot disappearance amplitude Vppw and less than the control amplitude Vppc, namely, an amplitude corresponding to the control margin C.

The experiment described above is conducted as the example of the invention. It is also acknowledged that similar advantages are provided if the experiment is conducted under the conditions in the following ranges:

Photoconductor diameter: from 20 to 60

Charging roll diameter: from 10 to 14

Charging roll abutment load: from 300 gf to 1000 gf (value resulting from correcting charging roll's own weight)

Frequency of charging bias: from 600 Hz to 2400 Hz

Range of first Vpp: Dependent on photoconductor film thickness and environment from 1200 Vpp at thin film high temperature high humidity (20 μm 28 degrees 85% RH) to 2600 Vpp at thick film low temperature low humidity (45 μm 10 degrees 15% RH).

Second Vpp: Value lower than first Vpp by from 100 V to 500 V

Photoconductor film thickness: from 20 μm to 45 μm. If the photoconductor film thickness is less than 20 μm, a white point scarcely occurs.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

an image carrier that includes a photoconductive layer on which an electrostatic latent image is formed;

a charging member that comes in contact with the image carrier and charges the photoconductive layer; and a feeding section that supplies a current to the charging member by applying a vibration voltage with an alternating current component superposed on a direct current component, wherein the alternating current component containing a first amplitude that eliminates charging non-uniformity when the vibration voltage is applied with a uniform amplitude and a second amplitude that is smaller than the first amplitude but higher than a saturation point amplitude, is periodically provided.

2. The image forming apparatus as claimed in claim 1, wherein the feeding section applies the vibration voltage containing at least one cycle of the first amplitude and at least one cycle of the second amplitude while an arbitrary position of the photoconductive layer passes through a discharge region formed on the periphery of a contact position where the image carrier comes into contact with the charging member.

3. The image forming apparatus as claimed in claim 1, wherein the second amplitude causes the charging non-uniformity to occur when the feeding section applies a vibration voltage containing only the second amplitude.

4. The image forming apparatus as claimed in claim 2, wherein the feeding section applies the vibration voltage containing only one cycle of the second amplitude while the arbitrary position of the photoconductive layer passes through the discharge region.

5. The image forming apparatus as claimed in claim 2, wherein number of cycle of the second amplitude is less than number of cycle of the first amplitude.

6. An image forming apparatus comprising:

an image carrier that includes a photoconductive layer on which an electrostatic latent image is formed;

a charging member that comes in contact with the image carrier and charges the photoconductive layer; and a feeding section that supplies a current to the charging member by applying a vibration voltage with an alternating current component superposed on a direct current component, wherein the alternating current component contains cycles each having a first amplitude that eliminates charging non-uniformity when the vibration voltage is applied with a uniform amplitude and cycles each having a second amplitude that is smaller than the first amplitude but higher than a saturation point amplitude, and at least one of the cycles having the second amplitude following two or more consecutive cycles of the first amplitude.

7. An image forming apparatus comprising:

an image carrier that includes a photoconductive layer on which an electrostatic latent image is formed;

a charging member that comes in contact with the image carrier and charges the photoconductive layer; and a feeding section that supplies a current to the charging member by applying a vibration voltage with an alternating current component superposed on a direct current component, wherein the alternating current component contains cycles each having a first amplitude that eliminates charging non-uniformity when the vibration voltage is applied with a uniform amplitude and half cycles each having a second amplitude that is smaller than the first amplitude, and each half cycle having the second amplitude sandwiched between the cycles having the first amplitude.

8. An image forming apparatus comprising:

an image carrier that includes a photoconductive layer on which an electrostatic latent image is formed;

a charging member that comes in contact with the image carrier and charges the photoconductive layer; and a feeding section that supplies a current to the charging member by applying a vibration voltage with an alternating current component superposed on a direct current component, wherein the alternating current component contains cycles each having a first amplitude that eliminates charging non-uniformity when the vibration voltage is applied with a uniform amplitude and cycles each having a second amplitude that is smaller than the first amplitude but higher than a saturation point amplitude, and when applying the vibration voltage with the alternating current component being in the cycle having the second amplitude, the feeding section shifts the direct current component of the vibration voltage.

* * * * *